US005390848A

United States Patent [19]

Gungner et al.

[11] Patent Number: 5,390,848

[45] Date of Patent: Feb. 21, 1995

[54] PRODUCT SLEEVE WITH PRODUCT SUPPORTS

[75] Inventors: Gregory Gungner, Port Coquitlam; John Zimmermann, Scarborough, both of Canada

[73] Assignee: Somerville Packaging, Divison of Paperboard Industries Corporation, Mississauga, Canada

[21] Appl. No.: 20,752

[22] Filed: Feb. 22, 1993

[51] Int. Cl.[6] ..... B65D 5/42

[52] U.S. Cl. ..... 229/103.2; 229/185; 206/197; 206/140

[58] Field of Search ..... 229/40, 185, 198.2; 206/140, 193, 197, 434

[56] References Cited

U.S. PATENT DOCUMENTS

| | | | |
|---|---|---|---|
| 3,029,999 | 4/1962 | DePaul | 229/40 |
| 3,478,951 | 11/1969 | Graser | 206/14 R X |
| 3,545,667 | 12/1970 | Vjecsner | 229/198.2 |
| 4,077,095 | 3/1978 | Oliff | 206/140 X |
| 4,433,807 | 2/1984 | Ganz | 206/140 X |
| 4,773,540 | 9/1988 | Schwoter | 206/140 X |
| 5,002,225 | 3/1991 | Bienaime | 206/140 X |
| 5,031,770 | 7/1991 | Chaussadas | 229/40 X |
| 5,080,280 | 1/1992 | Krano | 229/40 |
| 5,094,347 | 3/1992 | Schuster | 206/140 X |
| 5,107,986 | 4/1992 | Cooper . | |

FOREIGN PATENT DOCUMENTS

| | | |
|---|---|---|
| 1188060 | 9/1959 | France . |
| 9204251 | 3/1992 | WIPO . |

OTHER PUBLICATIONS

A dispensing box sold by Procter & Gamble Inc. under the trademark Bounce.

*Primary Examiner*—Allan N. Shoap
*Assistant Examiner*—Christopher J. McDonald

[57] ABSTRACT

A product sleeve for holding (typically) four products, such as bottles, has a protuberance between pairs of products to assist in holding the products in portion within the sleeve. The protuberances are formed by tabs hinged to one end panel of the product sleeve blank. These tabs have a notch and at least one further hinge line. These tabs may be pushed through openings in the other end panel of the blank so that they fold about their hinge lines to form the noted protuberances and the notch in the tabs lock to a portion of the other end panel.

8 Claims, 9 Drawing Sheets

FIG. 7.
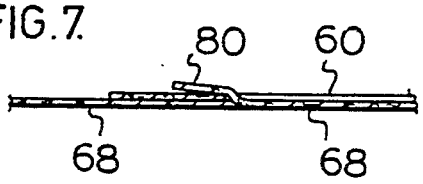
FIG. 6.
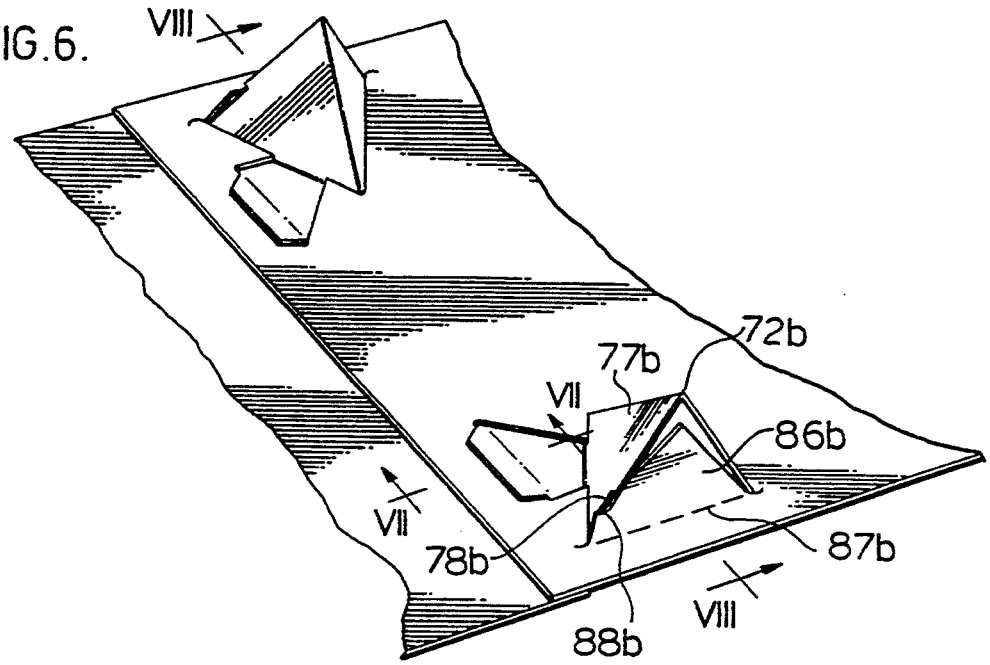
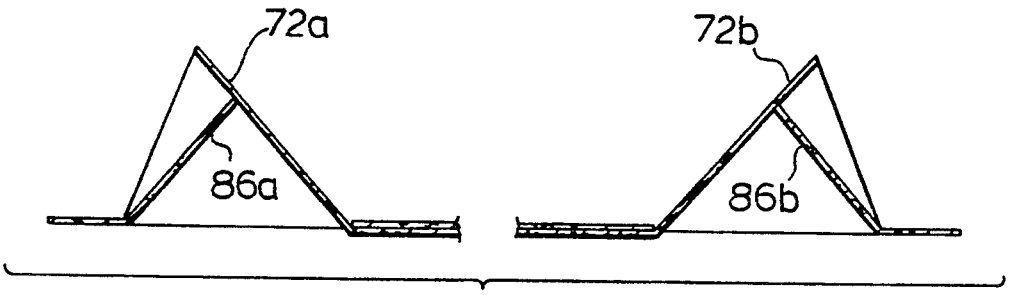
FIG. 8.

PRODUCT SLEEVE WITH PRODUCT SUPPORTS

BACKGROUND OF THE INVENTION

1. Field of the Invention

This invention relates to a paperboard product sleeve blank and a product sleeve.

2. Description of the Related Art

A common form of packaging for pudding cups, yoghurt cups, bottles, and the like is a sleeve for holding a number of the products. Typically such a sleeve holds four products. Because the sleeves are open at either end a problem in the field has been that of products falling out cf the sleeves.

This invention seeks to provide a product sleeve which more securely holds products within the sleeve.

SUMMARY OF THE INVENTION

According to the present invention, there is provided a paperboard product sleeve blank having opposite sides and a first and second end and comprising: a plurality of panels joined end-to-end at transverse hinge lines, a tab joined at a hinge line to the panel of said plurality of panels which is at said first end, said first end panel tab having at least one further hinge line, said tab comprising a first triangular portion between said hinge line and said further hinge line and a second triangular portion extending from said further hinge line such that said first end panel tab may be folded about said hinge line and said at least one further hinge line into a protuberance, said first end panel tab also having a notch, and an opening through the panel of said plurality of panels at said second end sized to receive said first end panel tab when said first end panel tab is folded into said protuberance, said notch of said first end panel tab for engaging with a portion of said second end panel in order to lock said first end panel tab within said opening and to lock said first end panel tab in its folded state as said protuberance, whereby said first end panel tab, when locked within said opening in a folded state as a protuberance, holds said plurality of panels in a sleeve configuration and is for abutting the base of products within the sleeve to assist in maintaining the products in position.

In accordance with another aspect of the invention, there is provided a paperboard product sleeve comprising: a plurality of panels joined end-to-end at transverse hinge lines terminating at a first and second bottom panel, an opening through said second bottom panel, a tab joined to said first bottom panel at a hinge line and folded at said hinge line and folded at at least one further hinge line which makes an angle with said hinge line into a protuberance, said folded tab protuberance having a notch, said folded tab protuberance received through said opening with said notch engaging with a portion of said second bottom panel to lock said folded tab protuberance within said opening in its folded state such that said folded tab protuberance assists in holding said plurality of panels in a sleeve configuration, said folded tab protuberance for abutting the base of products within the sleeve to assist in maintaining the products in position.

BRIEF DESCRIPTION OF THE DRAWINGS

In the figures which disclose example embodiments of the invention,

FIG. 6 is a fragmentary perspective view of a portion of a product sleeve made in accordance with this invention, FIG. 7 is a cross-sectional view along the lines VII—VII of FIG. 6, FIG. 8 is a cross-sectional view along the lines VIII—VIII of FIG. 6.

DESCRIPTION OF THE PREFERRED EMBODIMENTS

Figure 1:
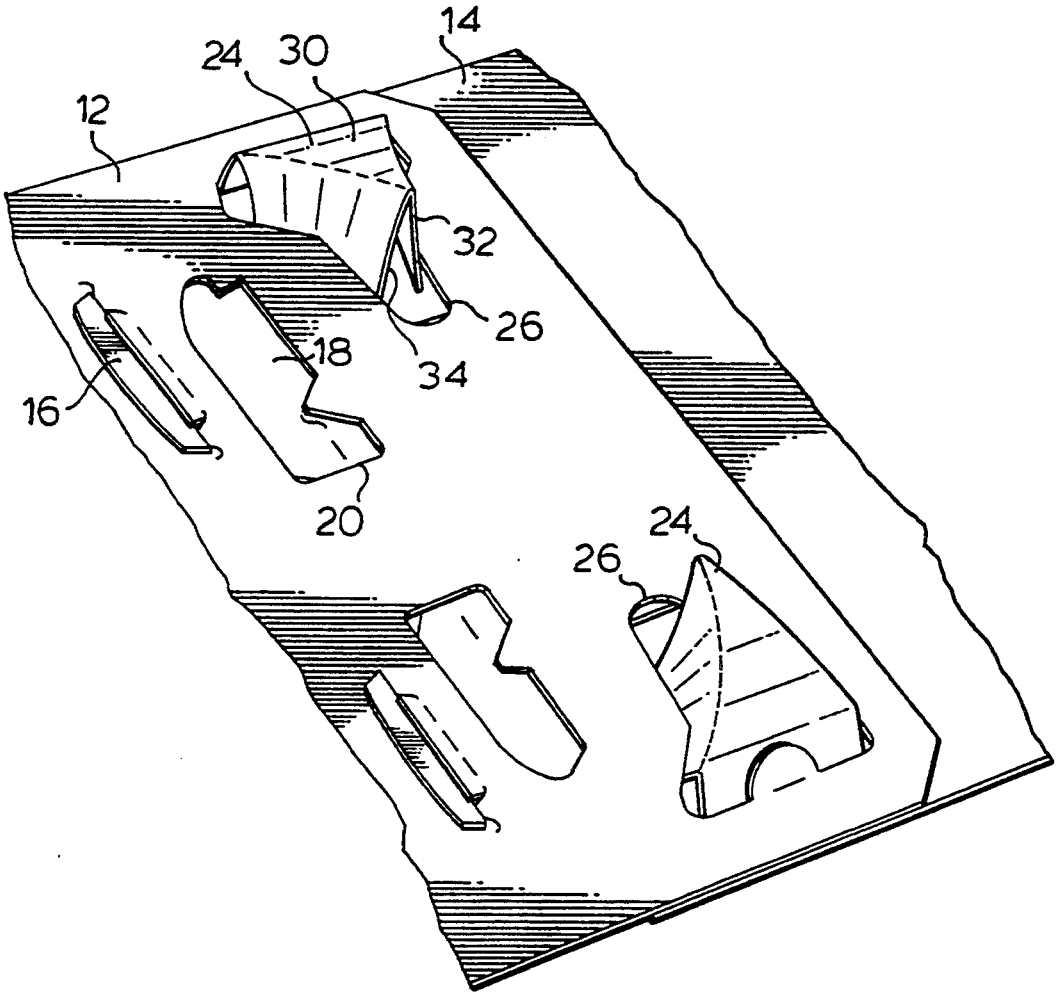
FIG.1.(PRIOR ART)
FIG. 1 is a perspective fragmentary view of a prior art product sleeve.
Figure 2:
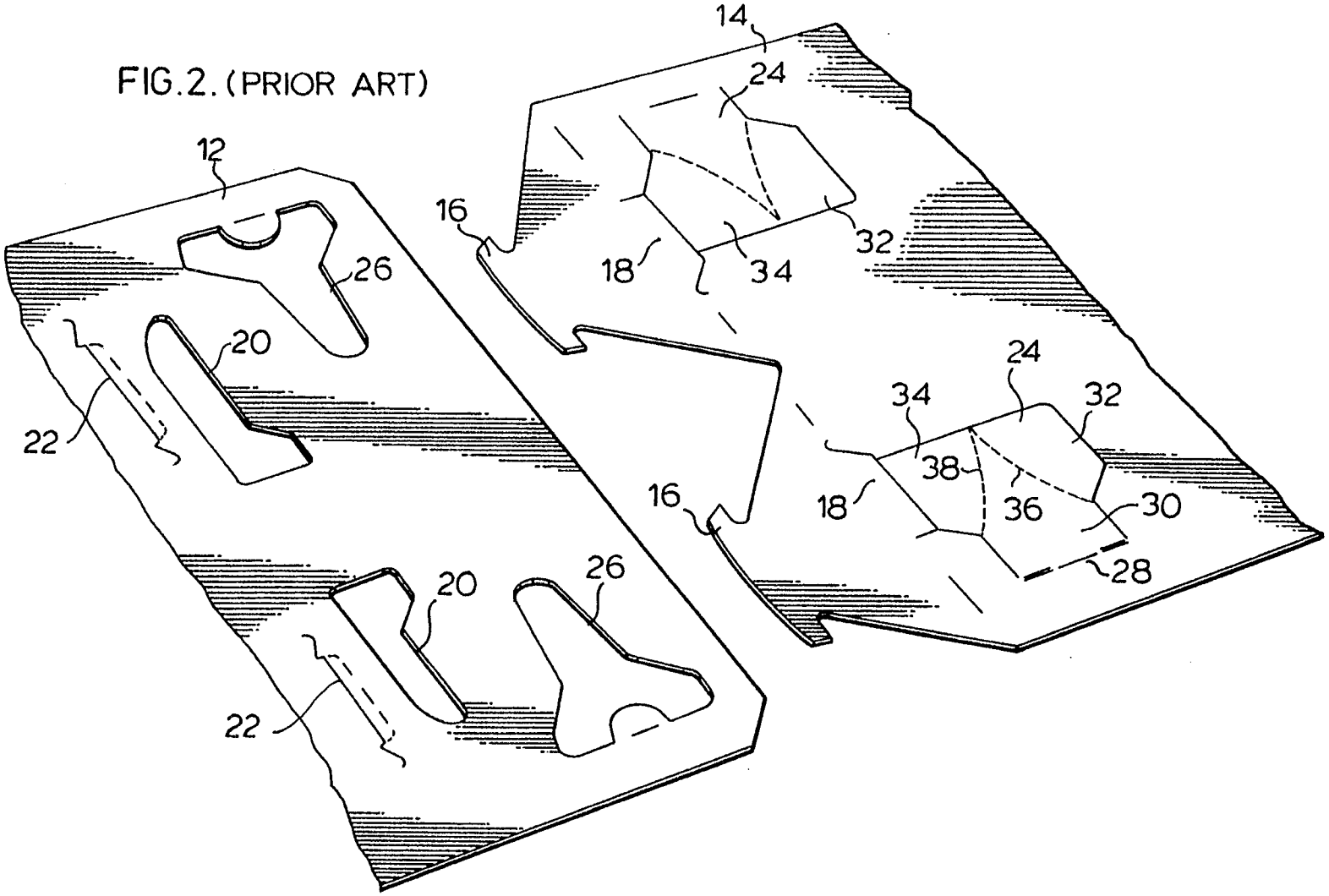
FIG. 2. (PRIOR ART)
FIG. 2 is a perspective fragmentary view of the two ends of a prior art product sleeve blank.

FIG. 1 shows a known product sleeve with means to assist in preventing products from slipping out of the sleeve. The sleeve blank from which this known sleeve is formed is shown in FIG. 2, the blank comprises a number of panels hinged end-to-end. A portion the end panels 12 and 14 is shown in FIG. 2. End panel 14 has oppositely directed tongues 16 and 18. Tongues 18 are intended to overlap ledges 20 of end 12 and, thereafter, tongues 16 are pushed through and locked into slits 22 of end 12. This result is shown in FIG. 1; in this way the tongues lock panel 14 to panel 12.

Returning to FIG. 2, the tongues are positioned so that tabs 24 of end panel 14 are registered with openings 26 in end panel 12 after the end panels 12 and 14 have been locked together. Tab 24 is joined to end panel 14 along hinge line 28 and the tab comprises a base portion 30 and two wings 32 and 34. The wings are joined to the base 30 along hinge lines 36 and 38.

With the tabs 24 registered with openings 26, the base of each tab may be pushed so that the tabs rise through the openings 26. This will cause the wings to hinge about hinge lines 36 and 38 since the openings 26 are smaller than the tabs 24 but do accommodate base 30 of the tabs. The result is shown in FIG. 2. Products are inserted into the sleeve prior to pushing tabs 24 through openings 26. Consequently, after the products are in position and the tabs are pushed into place, the tabs form protuberances which abut the base of the products and assist in keeping the products in place within the sleeve.

Figure 3:
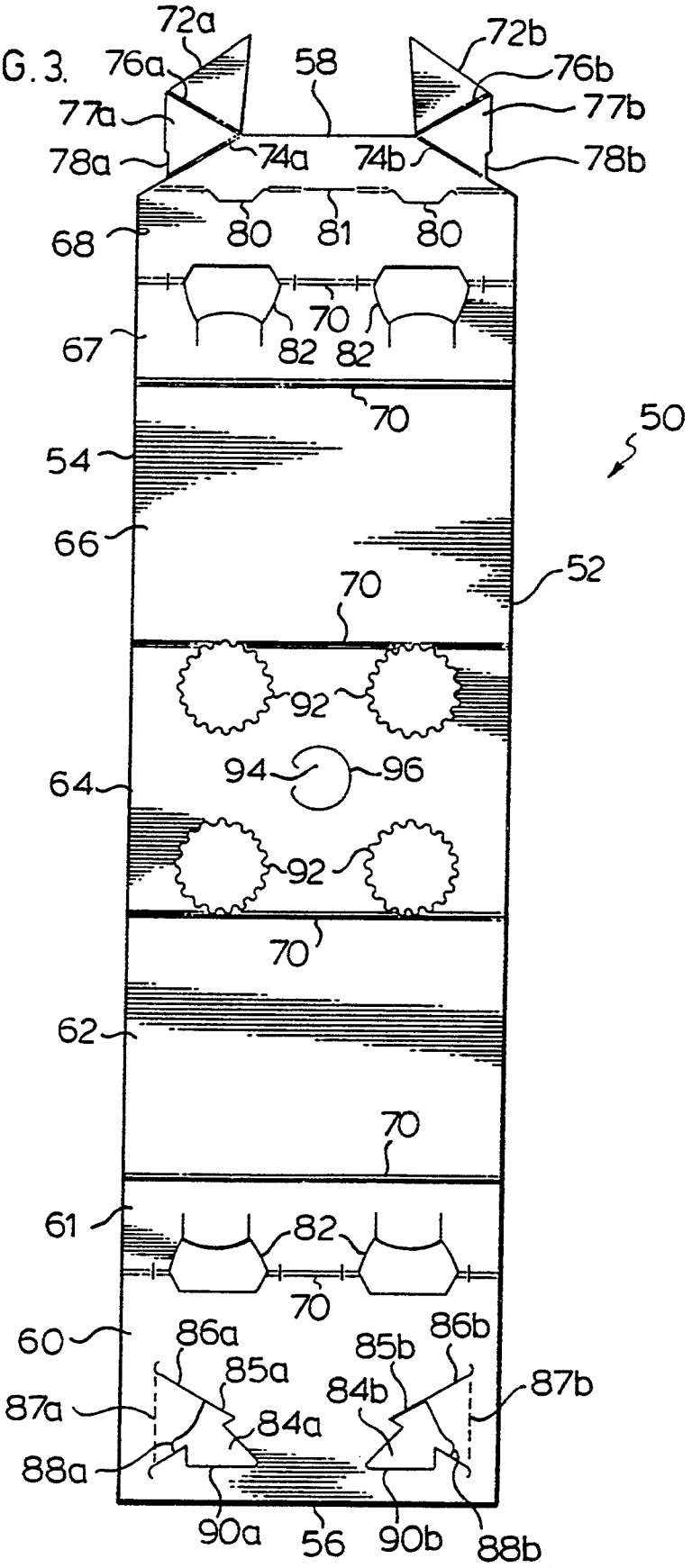
FIG. 3 is a plan view of a product sleeve blank made in accordance with this invention.

FIG. 3 is a plan view of a product sleeve blank made in accordance with this invention. Turning to FIG. 3, a product sleeve blank 50 has sides 52 and 54 and ends 56 and 58. The blank 50 comprises a plurality of panels 60, 61, 62, 64, 66, 67, and 68 joined end-to-end at transverse hinge line 70.

Tabs 72*a* and 72*b* are joined at hinge line 74*a* and 74*b*, respectively, to panel 68. Each of the tabs 72*a*, 72*b* has a generally parallelepiped-shape and hinge lines 76*a*, 76*b* divide each tab into two triangular portions, one 77*a*, 77*b* extending between hinge line 74*a* or 74*b* and hinge line 76*a* or 76*b* and the other extending from hinge line 76*a* or 76*b*. Each tab has a notch 76*a*, 76*b* in its side.

Panel 68 also has a pair of tongues 80 formed therein which interrupt transverse hinge line 81.

Panel 60, which is at end 56 of the product sleeve blank, has a pair of openings 84*a*, 84*b* therethrough. It will be noted that each opening has a triangular portion 85*a*, 85*b*. A tab 86*a*, 86*b* extends within the triangular portion 85*a*, 85*b* of each opening 84*a*, 84*b* and is hinged to panel 60 at hinge lines 87*a*, 87*b*, respectively. Each tab, 86*a*, 86*b* has a notch 88*a*, 88*b* therein. End panel 60 also has ledges 90*a*, 90*b* extending along an edge of openings 84*a*, 84*b* proximate end 56.

A pair of product base receiving openings 82 extend between panels 67 and 68 and another pair of such openings extend between panels 60 and 61. Medial panel 64 has four product stem receiving openings 92. This medial panel also has a push away tab 94 within finger receiving opening 96.

The assembly of product sleeve blank 50 into a product sleeve is illustrated by reference to FIGS. 4 through 9.

Figure 4:
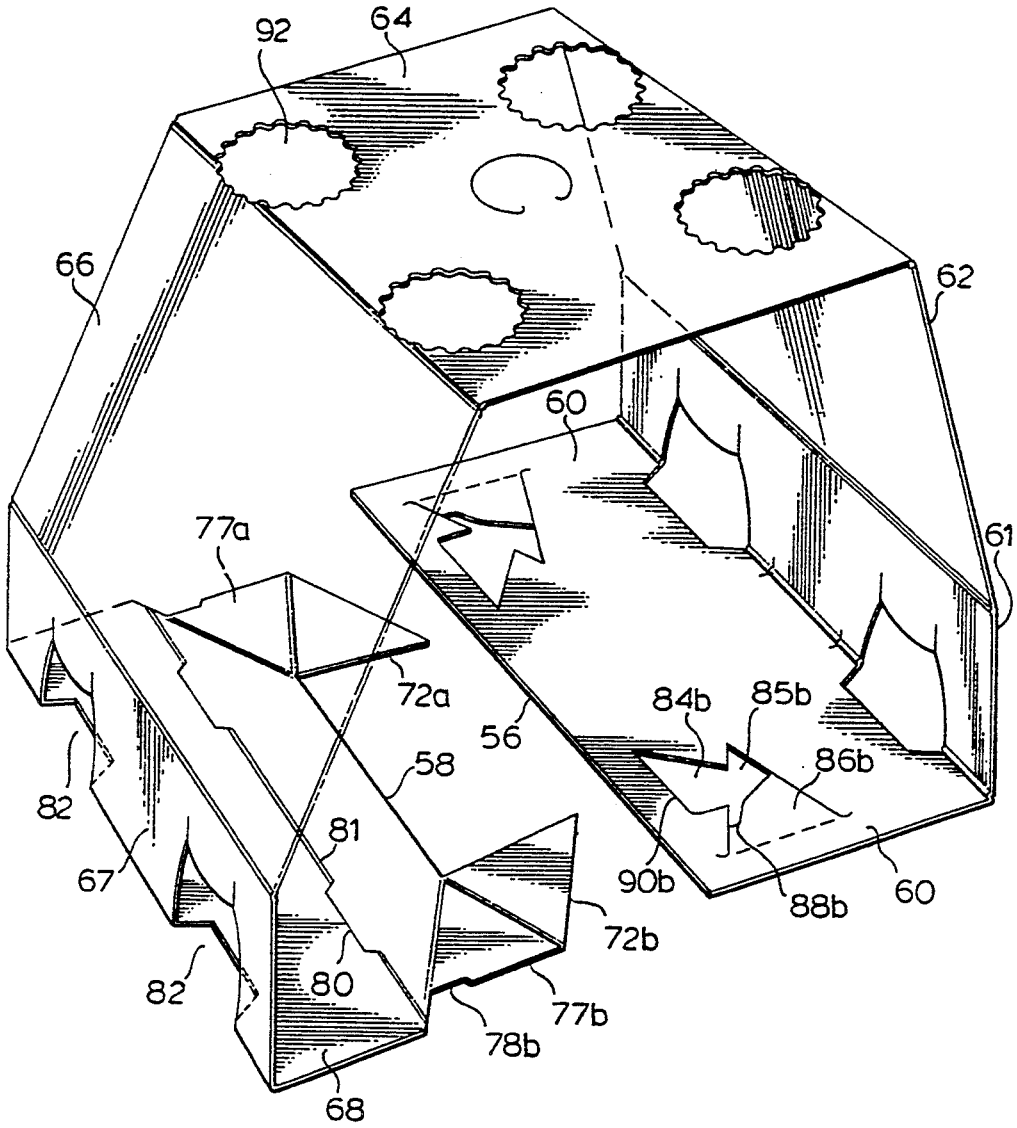
FIG. 4 is a perspective view of the product sleeve blank of this invention partially folded into a sleeve.

Turning to FIG. 4, the product sleeve blank of FIG. 3 has been partially folded such that panel 68 has become a first bottom panel and panel 60 has become a second bottom panel. Panels 61, 62 and 67, 66 have become side panels and medial panel 64 has become a top panel.

Figure 5:
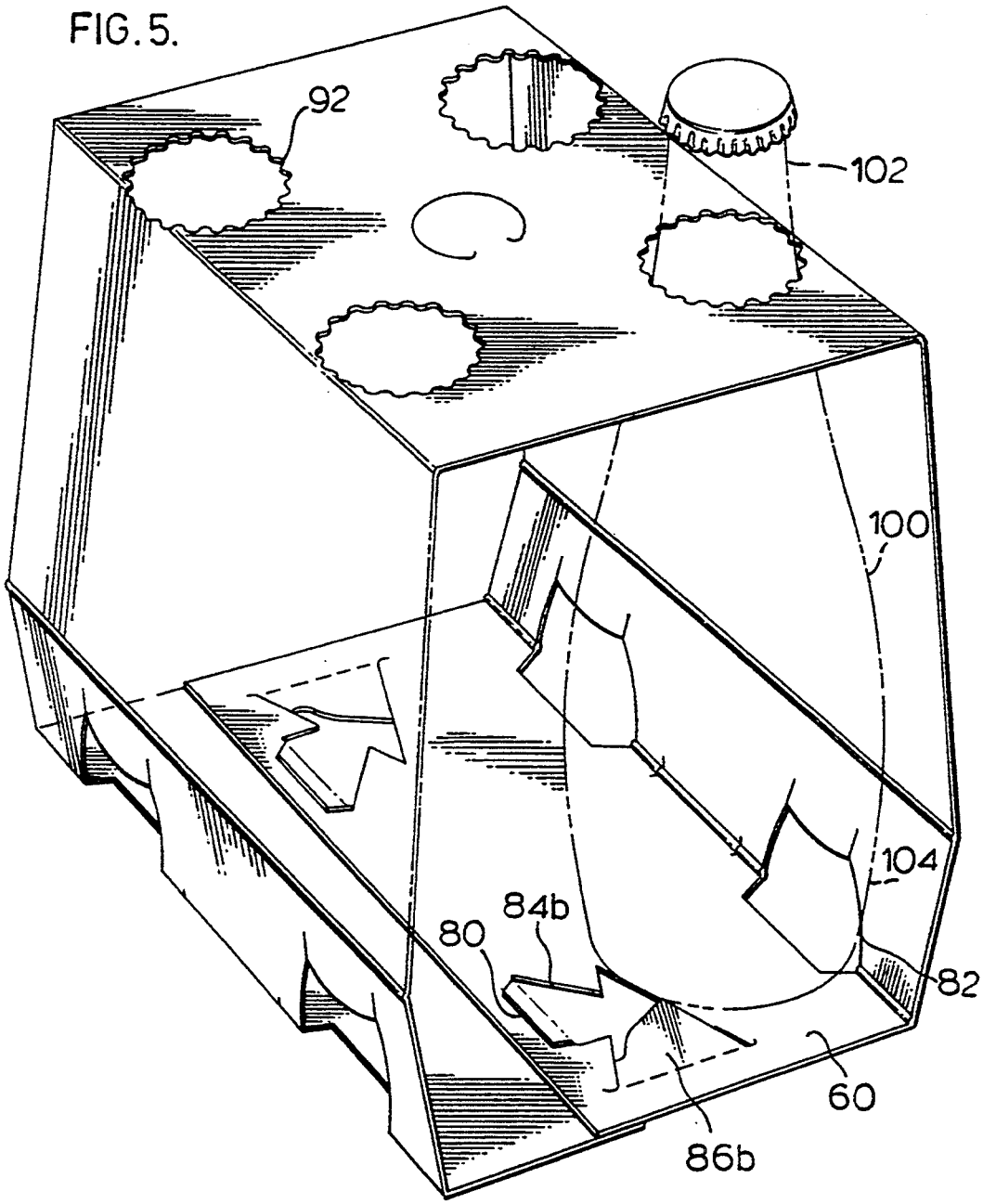
FIG. 5 is a perspective view of a partially assembled product sleeve made in accordance with this invention.

To continue the assembly of the product sleeve, panel 60 is overlapped with panel 68 and the panel is flexed about hinge line 81 so that tongues 80 cant upwardly. In this position, the tongues 80 may be brought through openings 84*a*, 84*b* and overlapped with ledges 90*a*, 90*b*. FIG. 5 illustrates the product sleeve at this stage in the assembly. The tongues 80 are positioned so that when they are overlapped with ledges 90*a*, 90*b*, the basal triangular portion 77*a*, 77*b* of tabs 72*a*, 72*b* is in registration with the triangular portion 85*a*, 85*b* of openings 84*a*, 84*b*. Furthermore, the triangular portion 85*a*, 85*b* of the openings is sized to receive the triangular base portion 77*a*, 77*b* of the tabs. At this stage, a product, such as the bottle 100 illustrated in phantom in FIG. 5, is inserted with its stem 102 through a stem receiving opening 92 and its base 104 received by a product base receiving opening 82. It will be apparent that four bottles may be received by the partially assembled product sleeve in this way.

Once the products have been received by the partially assembled sleeve, a force is applied to the triangular base portion 77*a*, 77*b* of tabs 72*a*, 72*b* so that the tabs are punched up through the triangular portion 85*a*, 85*b* of openings 84*a*, 84*b*. As the tabs are pushed upwardly, they fold about hinge lines 74*a*, 74*b* and 76*a*, 76*b* into a protuberance. Further, as the tabs are folded into protuberances, they fold tabs 86*a*, 86*b* upwardly about their respective hinge lines 87*a*, 87*b*. Continued upward pressure forms an opening in the folded tab 72*a*, 72*b* into which tab 86*a*, 86*b* may be received. The hinge lines 87*a*, 87*b* impart a bias to the tabs 86*a*, 86*b* which causes the tabs 86*a*, 86*b* to snap into these forming openings. However, tabs 86*a*, 86*b* are dimensioned such that when they snap into the forming openings in the protuberance forming tabs 72*a*, 72*b*, the notch 88*a*, 88*b* of these tabs 86*a*, 86*b* snaps into the notch 78*a*, 78*b* the protuberance forming tabs 72*a*, 72*b*. This result is illustrated in FIGS. 6 and 8.

Once these notches 78*a*, 88*a* and 78*b*, 88*b* have engaged, tabs 72*a*, 72*b* are locked to end panel 60 within openings 85*a*, 85*b* as protuberances. It will be noted from FIGS. 6 through 8 that the resulting product sleeve is held together solely by tongues 80 overlapping ledges 90*a*, 90*b* and the locked protuberance forming tabs 72*a*, 72*b*.

It will be noted that when the tabs 72*a*, 72*b* are folded into protuberances, they have a pyramid shape with a generally V-shaped profile which provides the opening into which tabs 86*a*, 86*b* may fit. This V-shaped profile is directed toward a side 52, 54 of the product sleeve. The hinge line 87*a*, 87*b* joining the tabs 86*a*, 86*b* to panel 60 are directed generally longitudinally of the panels.

Figure 9:
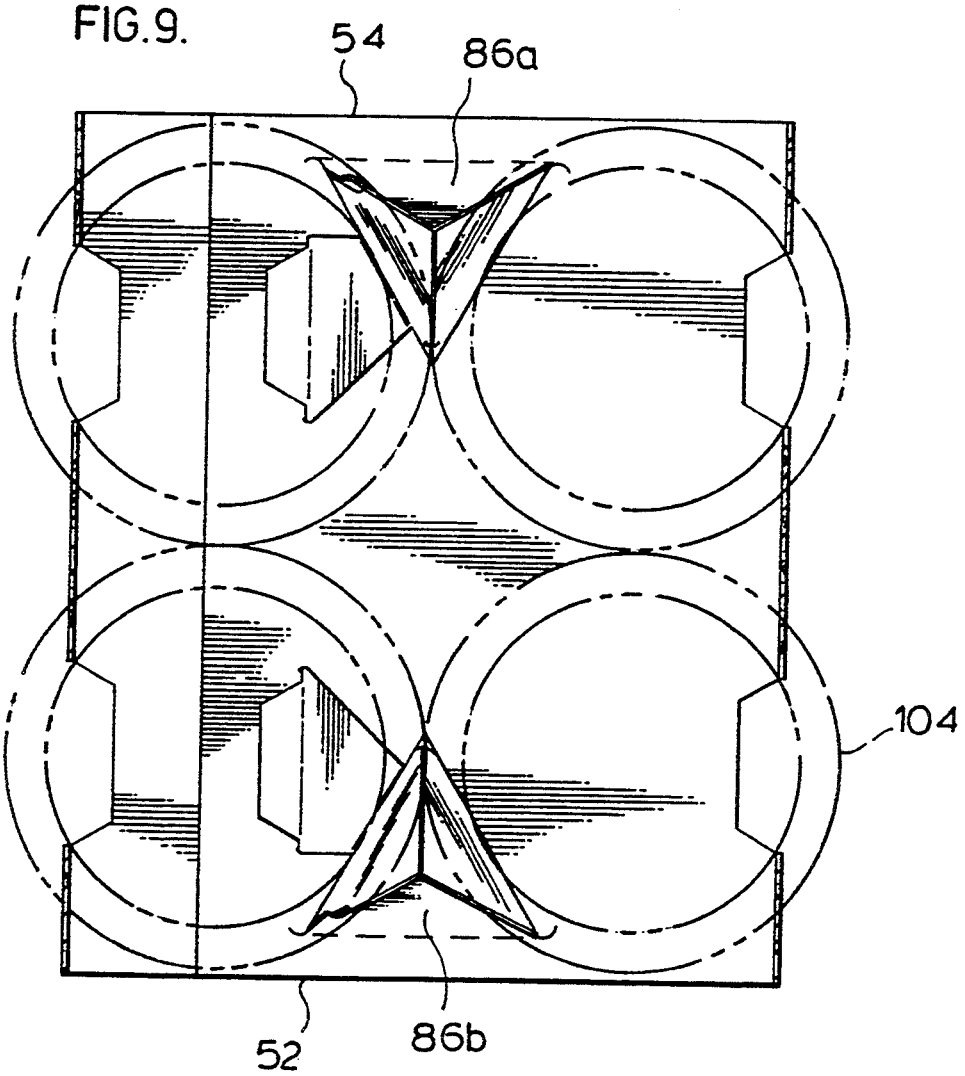
FIG. 9 is a bottom view of a product sleeve made in accordance with this invention.

As seen in FIG. 9, the protuberance forming tabs abut the base 104 of bottles within the sleeve to assist in maintaining the bottles within the sleeve.

Figure 10:
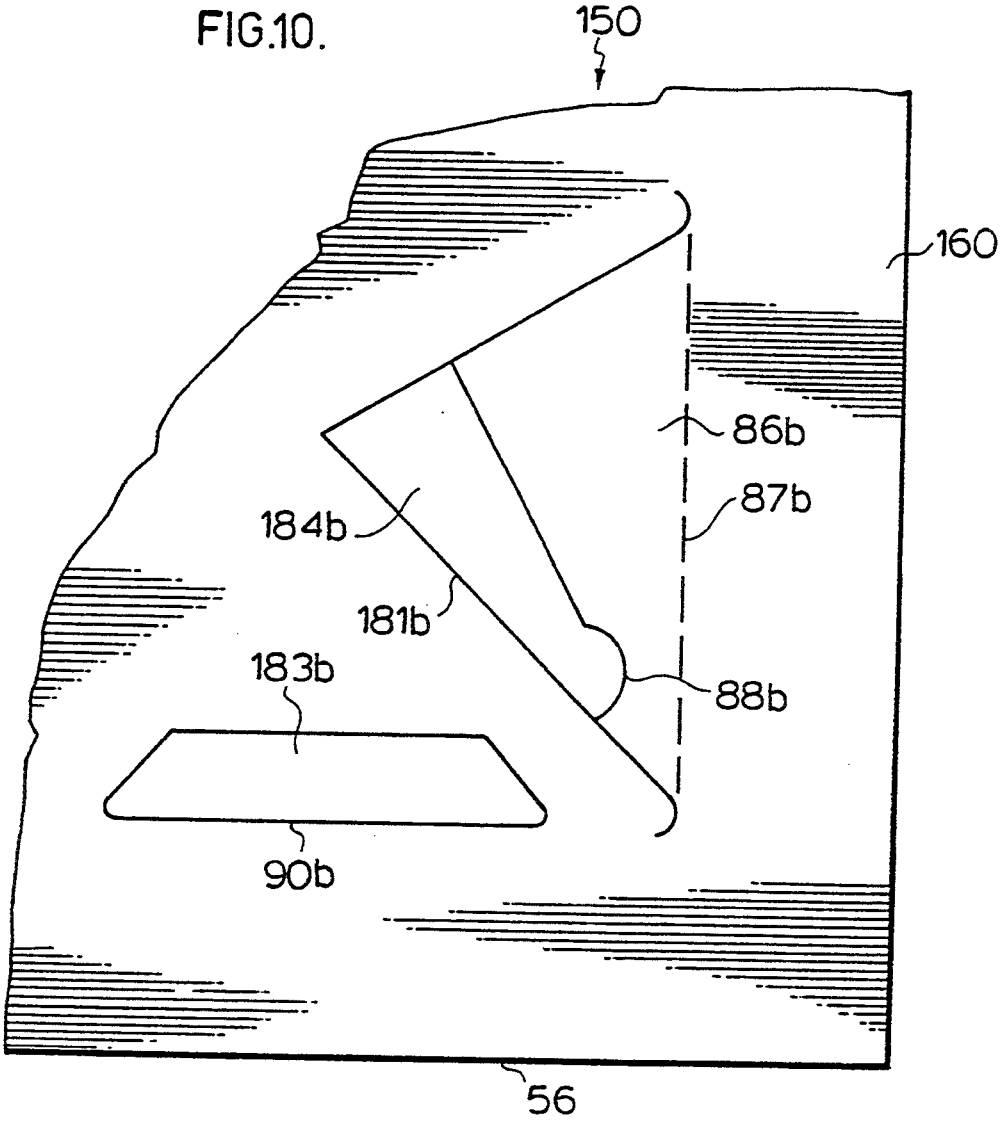
FIG. 10 is a perspective fragmentary view of a portion of the ends of a product sleeve blank made in accordance with another aspect of this invention.

FIG. 10 illustrates an alternate embodiment for the product sleeve blank. Turning to FIG. 10 wherein like parts have been given like reference numerals, panel 160 of sleeve blank 150 has an opening 184*b* therethrough bounded in part by side 181*b*. This opening is triangular in shape and contains tab 86*b* which is hinged to the panel at hinge line 87*b*. The tab has a notch 88*b* therein. Panel 160 has a further opening 183*b* with ledge 90*b* extending along one edge proximate end 56. Openings 183*b* and 184*b* take the place of opening 84*b* of sleeve blank 50 (seen in FIG. 3). A similar set of openings is present at the other side of the panel 160. The assembly of sleeve blank 150 is identical to that of sleeve blank 50, however, side 181*b* of opening 184*b* provides a firm abutment for the tab at the other end of the sleeve blank 150 as it is punched through the opening and this side 181*b* also provides a firm abutment for the resulting protuberance which strengthens the Joint.

Figure 11:
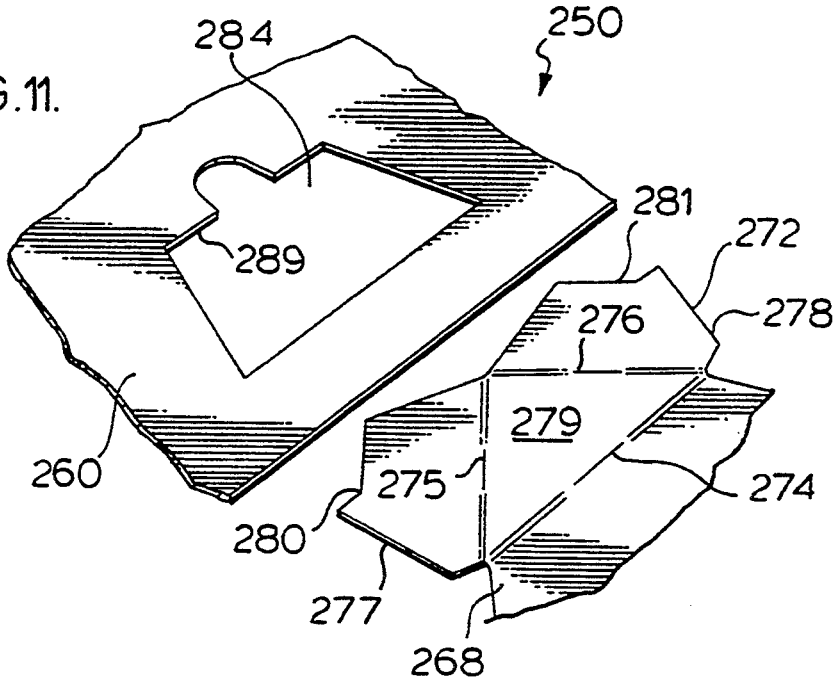
FIG. 11 is a partial plan view of a product sleeve blank made in accordance with another aspect of this invention.

FIG. 11 illustrates a second embodiment of the invention. With reference to FIG. 11, a product sleeve blank 250 has an end panel 260 and another end panel 268. The intermediate panels which are Joined by transverse hinge lines to these panels have not been shown in this fragmentary view but they may be similar to the intermediate panels that are illustrated in FIG. 3. Panel 260 has an opening 284 with an edge 289 and panel 268 has a tab 272. Tab 272 is joined to panel 268 by hinge line 274. Tab 272 has two further hinge lines, 275 and 276, which form a triangular base portion 279 on the tab bounded by hinge lines 274, 275 and 276. A first wing 277 extends from hinge line 275 and a second wing 278 extends from hinge line 276. Wing 277 has a notch 280 therein and wing 278 has a notch 281 therein.

Figure 12A:
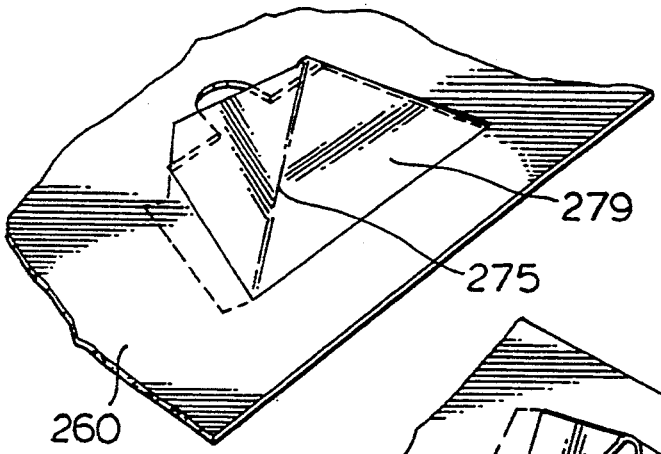
FIGS. 12*a* and 12*b* are perspective fragmentary views of a portion of a product sleeve assembled from the blank of FIG. 10.
Figure 12B:
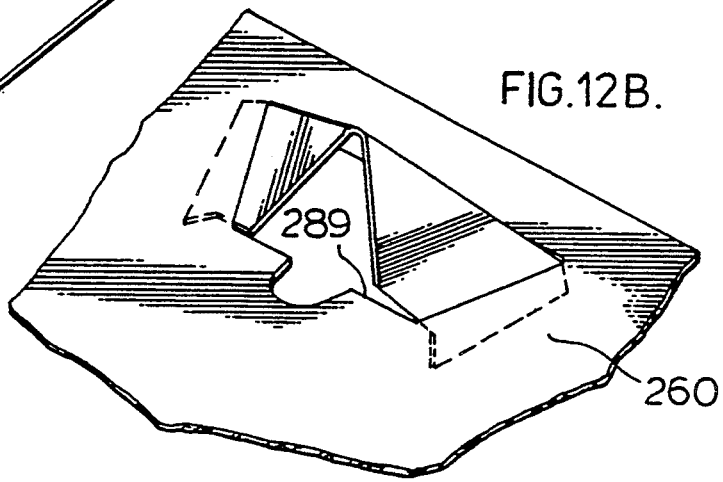

To assemble product sleeve blank 250 of FIG. 11, panel 260 is overlapped with panel 268 so that the triangular base portion 279 of tab 272 registers with opening 284. The tab is then punched up through opening 284 so that the tab is folded into a protuberance about hinge lines 274, 275, 276. This continues until notches 280 and 281 of the wings snap into edge 289 of the opening 284 due to the unfolding bias of the tabs imparted by the hinges 275 and 276. At this point, the protuberance forming folded tab is locked within the opening. FIGS. 12*a* and 12*b* illustrate this result. It will be appreciated that the locked protuberance forming tabs are sufficient in and of themselves to lock panel 268 to panel 260 and thereby hold the products sleeve together. Typically, there will be two tabs 272 and two openings 284 so that the product sleeve will be similar to that at FIG. 3 in that it may hold four products.

Other modifications would be apparent to those skilled in the art and, accordingly, the invention is defined in the claims.

What is claimed is:

1. A paperboard product sleeve blank having opposite sides and a first and second end and comprising:

a plurality of panels joined end-to-end at transverse hinge lines, a tab joined at a hinge line to the panel of said plurality of panels which is at said first end, said first end panel tab having at least one further hinge line making an angle with said hinge line, said tab comprising a first triangular portion between said hinge line and said further hinge line and a second triangular portion extending from said further hinge line such that said first end panel tab may be folded about said hinge line and said at least one further hinge line into a protuberance, said first end panel tab also having a notch, and an opening through the panel of said plurality of panels at said second end sized to receive said first end panel tab when said first end panel tab is folded into said protuberance, said notch of said first end panel tab for engaging with a portion of said second end panel in order to lock said first end panel tab within said opening and to lock said first end panel tab in its folded state as said protuberance, whereby said first end panel tab, when locked within said opening in a folded state as a protuberance, holds said plurality of panels in a sleeve configuration and is for abutting the base of products within the sleeve to assist in maintaining the products in position.

2. The product sleeve blank of claim 1 wherein said portion of said second end panel comprises a tab within said opening of said second end panel joined to said second end panel at a hinge line, said second end label tab having a notch.

3. The product sleeve blank of claim 2 wherein said first end panel has a tongue and said second end panel has a ledge, said tongue for overlapping with said ledge.

4. A paperboard product sleeve comprising:

a plurality of panels joined end-to-end at transverse hinge lines terminating at a first and second bottom panel, an opening through said second bottom panel, a tab joined to said first bottom panel at a hinge line and folded at said hinge line and folded at at least one further hinge line which makes an angle with said hinge line into a protuberance, said folded tab protuberance having a notch, said folded tab protuberance received through said opening with said notch engaging with a portion of said second bottom panel to lock said folded tab protuberance within said opening in its folded state such that said folded tab protuberance assists in holding said plurality of panels in a sleeve configuration, said folded tab protuberance for abutting the base of products within the sleeve to assist in maintaining the products in position.

5. The product sleeve of claim 4 wherein said portion of said second bottom panel comprises a tab joined to said second bottom panel at a hinge line at an edge of said opening of said second bottom panel and folded about said hinge line, said second bottom panel tab having a notch engaged with said notch of said first end panel tab.

6. The product sleeve of claim 5 wherein said first bottom panel has a tongue and said second bottom panel has a ledge, said tongue being overlapped with said ledge and assisting said protuberance in maintaining said plurality of panels in a sleeve configuration.

7. The product sleeve of claim 4 wherein said opening has an edge, said edge comprising said portion of said second end panel and said first bottom panel protuberance has a further notch, said notch and said further notch engaging said edge of said opening.

8. The product sleeve of claim 7 wherein said first bottom panel folded tab protuberance has a triangular base portion bounded by said hinge line, a further hinge line and a still further hinge line, a first wing extending from said further hinge line and having said notch, a second wing extending from said still further hinge line and having said further notch.

* * * * *

UNITED STATES PATENT AND TRADEMARK OFFICE

CERTIFICATE OF CORRECTION

PATENT NO. : 5,390,848

DATED : February 21, 1995

INVENTOR(S) : Gregory Gungner, et al

It is certified that error appears in the above-indentified patent and that said Letters Patent is hereby corrected as shown below:

Column 5, line 40, delete "label" and insert --panel--.

Signed and Sealed this

Second Day of May, 1995

*Attest:*

*Attesting Officer*

BRUCE LEHMAN

*Commissioner of Patents and Trademarks*